US007413418B2

(12) United States Patent
Lane et al.

(10) Patent No.: US 7,413,418 B2
(45) Date of Patent: Aug. 19, 2008

(54) FLUIDIC COMPRESSOR

(75) Inventors: Glenn H. Lane, Chandler, AZ (US); David M. Mathis, Phoenix, AZ (US); John F. Thurston, Mesa, AZ (US); William F. Ryan, Phoenix, AZ (US); James A. Wissinger, Carefree, AZ (US)

(73) Assignee: Honeywell International, Inc., Morristown, NJ (US)

( * ) Notice: Subject to any disclaimer, the term of this patent is extended or adjusted under 35 U.S.C. 154(b) by 600 days.

(21) Appl. No.: 10/901,839

(22) Filed: Jul. 28, 2004

(65) Prior Publication Data

US 2006/0024180 A1 Feb. 2, 2006

(51) Int. Cl.
*F04B 35/02* (2006.01)
*F04B 17/00* (2006.01)

(52) U.S. Cl. ..... 417/397; 417/392

(58) Field of Classification Search ..... 417/392, 417/397; 137/835

See application file for complete search history.

(56) References Cited

U.S. PATENT DOCUMENTS 3,124,999 A 3/1964 Woodward
3,340,896 A * 9/1967 Mon et al. ..... 137/624.13
3,429,324 A * 2/1969 Brown et al. ..... 137/830
3,580,069 A * 5/1971 Warren et al. ..... 73/180
3,630,362 A * 12/1971 Matthews ..... 210/108
3,633,603 A 1/1972 Furlong et al.
3,680,578 A 8/1972 Davies
3,682,192 A 8/1972 Davies
3,720,217 A 3/1973 Matthews et al.
3,991,574 A 11/1976 Frazier
4,068,468 A 1/1978 Wood et al.
4,104,008 A 8/1978 Hoffmann et al.
4,161,308 A 7/1979 Bell et al.
4,405,292 A 9/1983 Bixby, Jr. et al.
4,807,515 A 2/1989 Briscoe et al.
4,871,302 A 10/1989 Clardy et al.
5,094,596 A * 3/1992 Erwin et al. ..... 417/397
5,195,560 A 3/1993 Achmad
5,374,025 A * 12/1994 Whelpley et al. ..... 248/550
5,879,137 A * 3/1999 Yie ..... 417/225
6,736,611 B2 5/2004 Putt et al.
6,736,612 B2 5/2004 Gibbons

* cited by examiner

*Primary Examiner*—Devon C. Kramer
*Assistant Examiner*—Jessica L Frantz
(74) *Attorney, Agent, or Firm*—Ingrassia Fisher & Lorenz

(57) ABSTRACT

A compressor system that is configured to compress the fluid from low pressure source to a higher pressure magnitude is powered from the same low pressure fluid source. The compressor system includes two piston assemblies that are coaxially coupled to one another, and that are of differing cross sectional areas. The low pressure fluid is used to move the larger piston assembly, which is in turn used to move the smaller piston assembly. Low pressure fluid is selectively admitted to the smaller piston assembly, and movement thereof is used to compress the low pressure fluid to a higher pressure magnitude. The compressor system uses a fluidic bistable amplifier, which also coupled to the low pressure fluid source, to control low pressure fluid flow to the larger piston assembly, to thereby control its movement.

27 Claims, 2 Drawing Sheets

FLUIDIC COMPRESSOR

TECHNICAL FIELD

The present invention relates to compressors and, more particularly, to a fluid-powered compressor that is controlled using one or more fluidic switches.

BACKGROUND

A gas turbine engine may be used to supply propulsion power to an aircraft. In addition to providing propulsion power, an aircraft gas turbine engine may also be used to supply either, or both, electrical and pneumatic power to the aircraft. For example, in the past some gas turbine engines include a bleed air port between the compressor section and the turbine section. The bleed air port allows some of the compressed air from the compressor section to be diverted away from the turbine section, and used for other functions such as, for example, main engine starting air, environmental control, cabin pressure control, and/or hydraulic system reservoir pressurization.

More recently, however, aircraft gas turbine engines are being designed to not include bleed air ports. This is in response to a desire to more fully utilize electrical power for main engine starting air, environmental control, and cabin pressure control. Thus, instead of using engine bleed air to support these various functions, the high pressure turbine may be used to drive one or more electrical generators to supply electrical power to support these functions.

Nonetheless, many aircraft still include various hydraulic systems and components. Such hydraulic systems and components may include one or more hydraulic fluid reservoirs. In many instances, these hydraulic fluid reservoirs may need to be pressurized to provide sufficient net positive suction head in order to prevent cavitation of the hydraulic pump (or pumps) in the hydraulic system. As was alluded to above, engine bleed air has been used in the past to pressurize hydraulic fluid reservoirs in at least some aircraft hydraulic fluid systems. However, by designing engines without bleed air ports, this source of air is unavailable to provide this function. Although other sources of air are available on an aircraft that is not configured to use engine bleed air, these sources of air may not be pressurized to a sufficient magnitude to adequately pressurize the hydraulic fluid reservoirs. Moreover, it may not be desirable or efficient to utilize the electrical power generated by the aircraft gas turbine engines to compress the air to a sufficient magnitude.

Hence, there is a need for a system that can pressurize the air from relatively low pressure air sources to a magnitude sufficient to pressurize one or more hydraulic fluid reservoirs, without relying on electrical power to do so. The present invention addresses at least this need.

BRIEF SUMMARY

The present invention provides a fluidic compressor that is powered from a low pressure air source, and that compresses the air from the same low pressure air source to a higher pressure magnitude.

In one embodiment, and by way of example only, a fluidic compressor a first piston cylinder, a second piston cylinder, a first piston, a second piston, a fluidic bistable amplifier, a first control valve, and a second control valve. The first piston cylinder defines a first piston chamber, and includes at least first, second, third, and fourth flow ports extending therethrough and in fluid communication with the first piston chamber. The second piston cylinder defines a second piston chamber, and includes at least an inlet flow port, an outlet flow port, and a vent port extending therethrough and in fluid communication with the second piston chamber. The inlet flow port is adapted to couple to a fluid source. The first piston is movably disposed within the first piston chamber and fluidly isolates the first and second flow ports from the third and fourth flow ports. The second piston is movably disposed within the second piston chamber and fluidly isolates the inlet and outlet flow ports from the vent port. The second piston is coupled to, and is configured to move in response to movement of, the first piston. The fluidic bistable amplifier includes an inlet nozzle, first and second control ports, and first and second outlet ports. The fluidic bistable amplifier inlet nozzle is adapted to couple to the fluid source. The fluidic bistable first and second control ports are coupled to the fourth and second flow ports, respectively. The fluidic bistable amplifier first and second outlet ports are coupled to the first and third flow ports, respectively. The first control valve is coupled to the first piston cylinder and is movable between an open position and a closed position, whereby the fluidic bistable amplifier second control port is fluidly coupled to, and fluidly isolated from, the first piston chamber, respectively. The second control valve is coupled to the first piston cylinder and is movable between an open position and a closed position, whereby the fluidic bistable amplifier first control port is fluidly coupled to, and fluidly isolated from, the first piston chamber, respectively.

In another exemplary embodiment, a system for supplying compressed air to an aircraft hydraulic system includes a low pressure air source, a first piston cylinder, a second piston cylinder, a first piston, a second piston, a fluidic bistable amplifier, a first control valve, and a second control valve. The low pressure air source is configured to supply a flow of relatively low pressure air. The first piston cylinder defines a first piston chamber and includes at least first, second, third, and fourth flow ports extending therethrough and in fluid communication with the first piston chamber. The second piston cylinder defines a second piston chamber and includes at least an inlet flow port, an outlet flow port, and a vent port extending therethrough and in fluid communication with the second piston cylinder. The inlet flow port is coupled to the low pressure air source to receive the flow of relatively low pressure air therefrom. The first piston is movably disposed within the first piston chamber and fluidly isolates the first and second flow ports from the third and fourth flow ports. The second piston is movably disposed within the second piston chamber and fluidly isolates the inlet and outlet flow ports from the vent port. The second piston is coupled to, and is configured to move in response to movement of, the first piston. The fluidic bistable amplifier includes an inlet nozzle, first and second control ports, and first and second outlet ports. The fluidic bistable amplifier inlet nozzle is coupled to the low pressure air source to receive the flow of relatively low pressure air therefrom. The fluidic bistable first and second control ports are coupled to the fourth and second flow ports, respectively, and to the low pressure air source to receive the flow of relatively low pressure air therefrom. The fluidic bistable amplifier first and second outlet ports are coupled to the first and third flow ports, respectively. A first control valve is coupled to the first piston cylinder and is movable between an open position and a closed position, whereby the fluidic bistable amplifier second control port is fluidly coupled to, and fluidly isolated from, the first piston chamber, respectively. The second control valve is coupled to the first piston cylinder and is movable between an open position and a closed position, whereby the fluidic bistable amplifier first control port is fluidly coupled to, and fluidly isolated from, the first piston chamber, respectively.

Other independent features and advantages of the preferred fluidic compressor will become apparent from the following detailed description, taken in conjunction with the accompanying drawings which illustrate, by way of example, the principles of the invention.

DETAILED DESCRIPTION OF PREFERRED EMBODIMENTS

The following detailed description is merely exemplary in nature and is not intended to limit the invention or the application and uses of the invention. Furthermore, there is no intention to be bound by any theory presented in the preceding background of the invention or the following detailed description of the invention. In this regard, although the following embodiments are described as being implemented in an aircraft environment, it will be appreciated that each can be implemented in numerous and varied environments.

Figure 1:
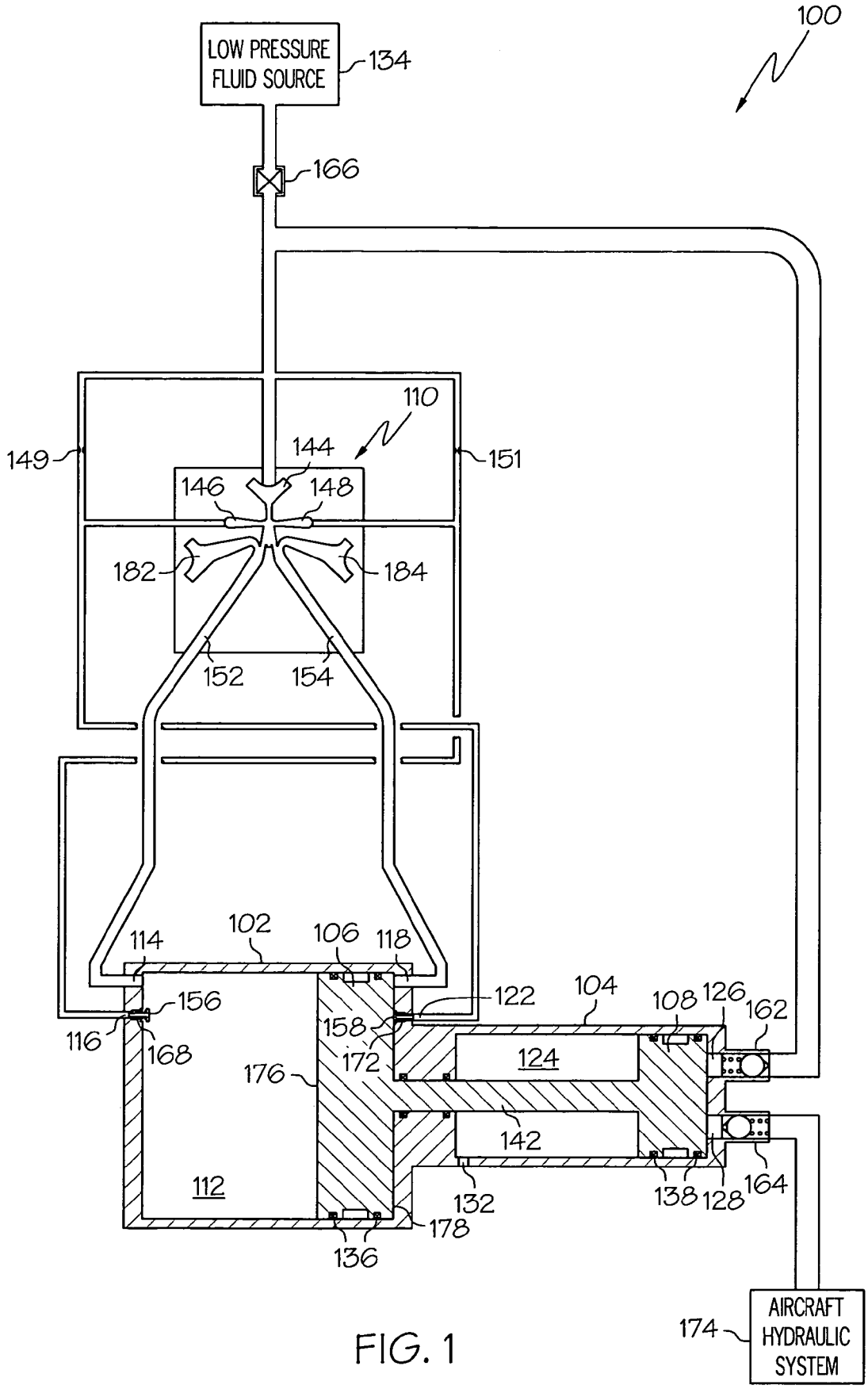
FIG. 1 is a simplified schematic representation of a fluidic compressor according to an exemplary embodiment of the present invention.

Turning now to the description, and with reference to FIG. 1, it is seen that in a first exemplary embodiment a compressor system 100 includes two piston cylinders—a first piston cylinder 102 and a second piston cylinder 104, two pistons—a first piston 106 and a second piston 108, and a fluidic bistable amplifier 110. The first piston cylinder 102 defines a first piston chamber 112, and includes four flow ports that extend through the cylinder 102 and into fluid communication with the first piston chamber 112. These four flow ports include a first flow port 114, a second flow port 116, a third flow port 118, and a fourth flow port 122. The purpose for each of these flow ports 114, 116, 118, 122 will be described in more detail further below.

The second piston cylinder 104, similar to the first piston cylinder 102, also defines a piston chamber 124, and includes a plurality of flow ports that extend through the piston cylinder 104 and into fluid communication with the piston chamber 124. However, rather than including four flow ports, the second piston cylinder 104 includes three flow ports—an inlet flow port 126, an outlet flow port 128, and a vent port 132. The inlet flow port 126 is fluidly coupled to a low pressure fluid source 134. In the depicted embodiment, the low pressure fluid source 134 is a low pressure air source such as, for example, an electrically-driven compressor for cabin air pressurization. It will be appreciated, however, that this is merely exemplary of one type of low pressure fluid source 134 that may be used to supply the compressor system 100, and that numerous other low pressure fluid sources in an aircraft may be used. It will additionally be appreciated that the compressor system 100 is not limited to use in an aircraft environment, but could be implemented in numerous and varied environments. Moreover, although the fluid within the fluid source 134 is preferably a gas such as, for example, air, it will be appreciated that any one of numerous other fluids, including various liquids, could be used.

The first piston 106, which is referred to hereinafter as the power piston 106, is movably disposed within the first piston cylinder piston chamber 112 and, via one or more seals 136, fluidly isolates the first 114 and second 116 flow ports from the third 118 and fourth 122 flow ports. Similarly, the second piston 108, which is referred to hereinafter as the high pressure piston 108, is movably disposed within the second piston cylinder piston chamber 124 and, also via one or more seals 138, fluidly isolates the inlet 126 and outlet 128 flow ports from the vent port 132. As is readily seen in FIG. 1, the power piston 106 and high pressure piston 108 are coupled together via a common coaxial shaft 142. Thus, movement of the power piston 106 results in a concomitant movement of the high pressure piston 108. The movement of the power piston 106 is controlled by the bistable fluidic amplifier 110, which will now be described in more detail.

The fluidic bistable amplifier 110 includes an inlet nozzle 144, first and second control ports 146 and 148, respectively, and first and second outlet ports 152 and 154, respectively. The fluidic bistable amplifier inlet nozzle 144 is fluidly coupled to the low pressure fluid source 134 and receives a flow of low pressure fluid therefrom. The fluidic bistable amplifier first 146 and second 148 control ports are also each coupled to the low pressure fluid source 134 preferably via first 149 and second 151 flow orifices, and are additionally coupled to the first piston cylinder fourth 122 and second 116 flow ports, respectively. The fluidic bistable amplifier first 152 and second 154 outlet ports are fluidly coupled to the first piston cylinder first 114 and third 118 flow ports, respectively.

The fluidic bistable amplifier inlet nozzle 144 is configured to accelerate the fluid flow received from the low pressure fluid source 134 to form a fluid jet. As is generally known, the accelerated fluid flow is directed out either the first 152 or second 154 outlet ports, depending on which control port 146, 148 fluid is flowing through. For example, if fluid is flowing through the first control port 146, this fluid flow deflects the fluid flowing through the inlet nozzle 144 into and through the second outlet port 154, via the well-known Coanda effect. Conversely, if fluid is flowing through the second control port 148, this fluid flow deflects the fluid flowing through the inlet nozzle 144 into and through the first outlet port 152.

In addition to the above-described components, it is seen that the compressor system 100 also includes two control valves 156 and 158, two check valves 162 and 164, and a filter 166. The two control valves 156 and 158 are each coupled to the first piston cylinder 102, and are each movable between an open position and a closed position. More specifically, the first control valve 156 is disposed partially within the second flow port 116 and extends into the first piston cylinder piston chamber 112, and the second control valve 158 is disposed partially within the fourth flow port 122 and also extends into first piston cylinder piston chamber 112.

The first 156 and second 158 control valves are each biased toward the open position by, for example, first 168 and second 172 bias springs, respectively. As will be described more fully further below, the power piston 106 moves the control valves 156, 158 to the closed position. When the first 156 or second 158 control valves are in the open position, the first piston cylinder piston chamber 112 is fluidly coupled to the respective fluidic bistable amplifier control port 146 or 148, via the respective flow control port 116 or 122. As may be appreciated, when the first 156 or second 158 control valves are in the closed position, the first piston cylinder chamber 112 is fluidly isolated from the respective fluidic bistable amplifier control port 146 or 148.

The check valves 162 and 164 are disposed in the second piston cylinder inlet flow port 126 and outlet flow port 128, respectively. The check valve 162, referred to herein as the inlet check valve 162, is configured to allow fluid flow from the low pressure fluid source 134 into the second piston cylinder piston chamber 124, and to prevent fluid flow out the second piston cylinder piston chamber 124 back toward the low pressure fluid source 134. The other check valve 164, referred to herein as the outlet check valve 164, is configured to allow fluid flow out of the second piston cylinder piston chamber 124 to an end use system 174, and to prevent fluid flow from the end use system 174 back into the second piston cylinder piston chamber 124. The end use system 174 may be any one of numerous systems that utilize pressurized fluid. For example, in the depicted embodiment, the end use system 174 is an aircraft hydraulic system and, more specifically, the hydraulic system reservoirs or accumulators within the hydraulic system that are pressurized with air.

The filter 166 is disposed between the low pressure fluid source 134 and both the second piston cylinder inlet flow port 136 and the fluidic bistable amplifier 110. The filter 166 may be any one of numerous types of air filtration elements that is configured to substantially remove any particulate that may be transported from the low pressure fluid source 134 by the low pressure fluid. Although the compressor system 100 is depicted as including a single filter 166, it will be appreciated that system 100 could be implemented with two or more filters 166. For example, instead of, or in addition to, the filter 166 shown in FIG. 1, one filter could be placed upstream of the fluidic bistable amplifier 110, and a second filter could be disposed upstream of the second piston cylinder inlet flow port 136.

The compressor system 100 is used to raise the pressure of the fluid in the low pressure fluid system 134, and supply the relatively pressurized fluid to the end use system 174. To do so, low pressure fluid from the low pressure fluid source 134 is supplied to the fluidic bistable amplifier 110 and the second piston cylinder 104. The fluidic bistable amplifier 110 controls the flow of low pressure fluid to the first piston cylinder 102 and thus, as was previously mentioned, the movement of the power piston 106. More specifically, the fluidic bistable amplifier 110 controls the flow of low pressure fluid to either a first side 176 or a second side 178 of the power piston 106, to thereby move the power piston 106 between a first position, in which the power piston 106 is disposed adjacent the first 114 and second 116 flow ports, and a second position, in which the power piston 106 is disposed adjacent the third 118 and fourth 122 flow ports.

For example, if the power piston 106 is in the second position, which is shown in FIG. 1, the power piston 106 has moved the second control valve 158 to the closed position. As a result, pressure will build up in the fluidic bistable amplifier first control port 146, which in turn causes the low pressure fluid flowing through the fluidic bistable amplifier inlet nozzle 144 to flow out the fluidic bistable amplifier second outlet port 154, and into the first piston cylinder third flow port 118. Low pressure fluid flow into the first piston cylinder third flow port 118 will impinge on second side 178 of the power piston 106, causing the power piston 106 to move toward the first position. As the power piston 106 moves toward the first position, the low pressure fluid present in the chamber 112 adjacent the first side 176 of the power piston 106 is forced out the chamber 112 via the first 114 flow port. It should be appreciated that a relatively small portion of the total flow out of the chamber 112 flows via the second 116 flow port. This minor flow joins the main fluid flow jet issuing from nozzle 144 and exiting outlet port 154.

The low pressure fluid that flows out of the first piston cylinder chamber 112 and through the first flow port 114, flows into the fluidic bistable amplifier first outlet port 152. However, the fluidic bistable amplifier 110 is preferably configured to include first and second leg vents 182, 184. Thus, this low pressure fluid flows into the fluidic bistable amplifier first outlet port 152 and exits the fluidic bistable amplifier via the first leg vent 182.

The power piston 106 continues to move toward the first position and when it contacts the first control valve 156, the power piston 106 moves the first control valve 156 to its closed position. As a result, fluid pressure builds up in the fluid bistable amplifier second control port 148, which in turn causes the fluid flow jet issuing from the fluidic bistable amplifier inlet nozzle 144 to switch to the fluidic bistable amplifier first outlet port 152, and into the first piston cylinder first flow port 114. Low pressure fluid flow into the first piston cylinder first flow port 114 will impinge on the first side 176 of the power piston 106, causing the power piston 106 to move toward the second position.

In response to the above-described movement of the first piston 106 between its first and second positions, the high pressure piston 108 is concomitantly moved between a first position and second position, respectively. As the high pressure piston 108 is moving to its first position, low pressure fluid from the low pressure fluid source 134 flows, via the inlet check valve 136, into the second piston cylinder piston chamber 124. Conversely, when the high pressure piston 108 is moving to its second position (shown in FIG. 1) the fluid within the second piston cylinder chamber 124 is compressed, exits the outlet port 128, and is supplied, via the outlet check valve 138, to the end-use system 174.

As is readily apparent from FIG. 1, the power piston 106 and first piston cylinder piston chamber 112 each have cross sectional areas larger than that of the high pressure piston 108 and the second piston cylinder piston chamber 124. The skilled artisan will appreciate that the ratio of these cross sectional areas is chosen based on the desired pressure ratio of the compressor system 100.

Figure 2:
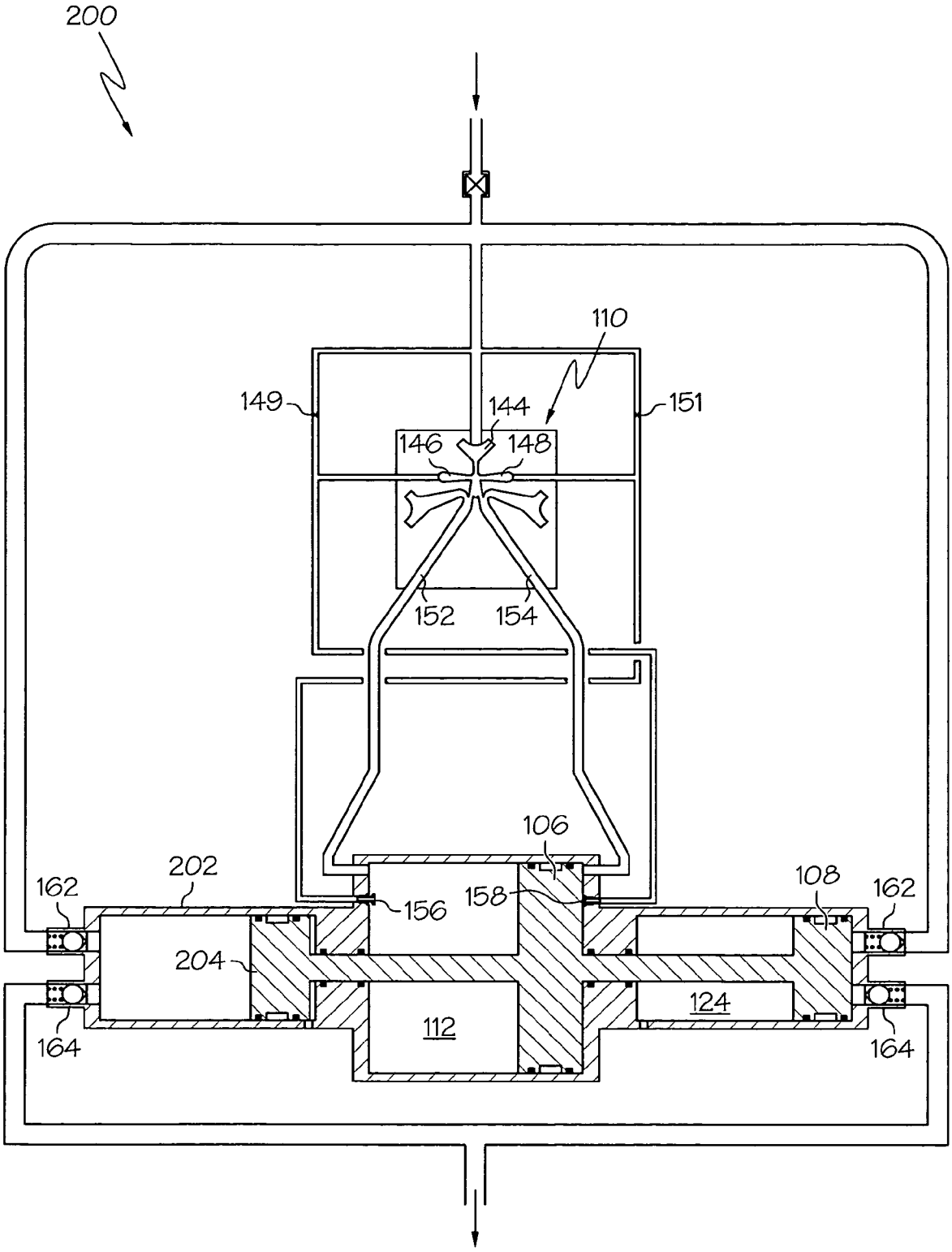
FIG. 2 is a simplified schematic representation of a fluidic compressor according to an exemplary alternate embodiment of the present invention.

In the embodiment depicted in FIG. 1, the compressor system 100 includes only a single high pressure piston 108. It will be appreciated, however, that the compressor system 100 could be configured with two power pistons 108. Such a system 200 is shown in FIG. 2, and includes a third piston cylinder 202 and a second high pressure piston 204. The third piston cylinder 202 and second high pressure piston 204 are configured substantially identical to the second piston cylinder 104 and first high pressure piston 108, and are arranged in mirror image thereto. Therefore, a detailed description of these components will not be provided.

The operation of the alternate compressor system 200 of FIG. 2 is substantially identical to the system 100 of FIG. 1, and so its operation will also not be described. It should be appreciated, however, that the second embodiment is more efficient than the first, in that the low pressure fluid is compressed during both strokes of the power piston 106.

The compressor systems 100, 200 disclosed herein are powered from a low pressure fluid source, and compress the fluid from the same low pressure source to a higher pressure magnitude.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A fluidic compressor, comprising:

a first piston cylinder defining a first piston chamber, the first piston cylinder including at least first, second, third, and fourth flow ports extending therethrough and in fluid communication with the first piston chamber;

a second piston cylinder defining a second piston chamber, the second piston cylinder including at least an inlet flow port, an outlet flow port, and a vent port extending therethrough and in fluid communication with the second piston chamber, the inlet flow port adapted to couple to a fluid source;

a first piston movably disposed within the first piston chamber and fluidly isolating the first and second flow ports from the third and fourth flow ports;

a second piston movably disposed within the second piston chamber and fluidly isolating the inlet and outlet flow ports from the vent port, the second piston coupled to, and configured to move in response to movement of, the first piston;

a fluidic bistable amplifier including an inlet nozzle, first and second control ports, and first and second outlet ports, the fluidic bistable amplifier inlet nozzle adapted to couple to the fluid source, the fluidic bistable amplifier first and second control ports coupled to the fourth and second flow ports, respectively, and in fluid communication with the fluidic bistable amplifier inlet nozzle upstream of where the fluidic bistable amplifier is adapted to couple to the fluid source, the fluidic bistable amplifier first and second outlet ports coupled to the first and third flow ports, respectively, the fluidic bistable amplifier configured such that (i) if fluid flows through the fluidic bistable amplifier first control port, then fluid entering the fluidic bistable amplifier inlet nozzle is directed into and through the fluidic bistable second outlet port and (ii) if fluid flows through the fluidic bistable amplifier second control port, then fluid entering the fluidic bistable amplifier inlet nozzle is directed into and through the fluidic bistable first outlet port;

a first flow orifice disposed upstream of the fluidic bistable amplifier first control port and in fluid communication with the fluidic bistable amplifier inlet nozzle upstream of where the fluidic bistable amplifier is adapted to couple to the fluid source; and a second flow orifice disposed upstream of the fluidic bistable amplifier second control port and in fluid communication with the fluidic bistable amplifier inlet nozzle upstream of where the fluidic bistable amplifier is adapted to couple to the fluid source;

a first control valve coupled to the first piston cylinder and movable between an open position and a closed position, whereby the fluidic bistable amplifier second control port is fluidly coupled to, and fluidly isolated from, the first piston chamber, respectively; and a second control valve coupled to the first piston cylinder and movable between an open position and a closed position, whereby the fluidic bistable amplifier first control port is fluidly coupled to, and fluidly isolated from, the first piston chamber, respectively.

2. The compressor of claim 1, further comprising:

an inlet check valve having an inlet port and an outlet port, the inlet check valve inlet port adapted to couple to the fluid source, the inlet check valve outlet port coupled to the second piston cylinder inlet flow port, the inlet check valve configured to allow fluid flow into the second piston chamber and prevent fluid flow out of the second piston chamber; and an outlet check valve having an inlet port and an outlet port, the outlet check valve inlet port coupled to the second piston cylinder outlet flow port, the outlet check valve configured to allow fluid flow out of the second piston chamber and prevent fluid flow into the second piston chamber.

3. The compressor of claim 1, further comprising:

a filter disposed upstream of the fluidic bistable amplifier inlet nozzle.

4. The compressor of claim 1, wherein the fluidic bistable amplifier further includes first and second leg vents fluidly coupled to the fluidic bistable amplifier first and second outlet ports, respectively.

5. The compressor of claim 1, wherein the first piston is moveable between at least a first position, in which the first piston is disposed adjacent the first and second flow ports, and a second position, in which the first piston is disposed adjacent the third and fourth flow ports.

6. The compressor of claim 5, wherein:

fluid flow through the fluidic bistable amplifier first outlet port moves the first piston toward the second position; and fluid flow through the fluidic bistable amplifier second outlet port moves the first piston toward the first position.

7. The compressor of claim 5, wherein:

movement of the first piston toward the first position draws fluid from the fluid source into the second piston chamber; and movement of the first piston toward the second position compresses the fluid drawn into the second piston chamber.

8. The compressor of claim 5, wherein:

the first piston moves the first control valve to the closed position when the first piston is moved to the first position; and the first piston moves the second control valve to the closed position when the first piston is moved to the second position.

9. The compressor of claim 1, wherein:

the first and second control valves are normally open, and are moved to the closed position by the first piston.

10. The compressor of claim 1, wherein the first and second control valves are disposed at least partially within the second and fourth flow ports, respectively.

11. The compressor of claim 1, wherein the first and second control valves are poppet valves.

12. The compressor of claim 1, further comprising:

a third piston cylinder defining a third piston chamber, the third piston cylinder including at least an inlet flow port, an outlet flow port, and a vent port extending therethrough and in fluid communication with the third piston cylinder, the third piston cylinder inlet flow port adapted to couple to the fluid source; and a third piston movably disposed within the third piston chamber and fluidly isolating the third piston cylinder inlet and outlet flow ports from the third piston cylinder vent port, the third piston coupled to, and configured to move in response to movement of, the first piston.

13. A fluidic compressor, comprising:

a first piston cylinder defining a first piston chamber, the first piston cylinder including at least first, second, third, and fourth flow ports extending therethrough and in fluid communication with the first piston chamber;

a second piston cylinder defining a second piston chamber, the second piston cylinder including at least an inlet flow port, an outlet flow port, and a vent port extending therethrough and in fluid communication with the second piston cylinder, the inlet flow port adapted to couple to a fluid source;

a third piston cylinder defining a third piston chamber, the third piston cylinder including at least an inlet flow port, an outlet flow port, and a vent port extending therethrough and in fluid communication with the third piston cylinder, the third piston cylinder inlet flow port adapted to couple to the fluid source;

a first piston movably disposed within the first piston chamber and fluidly isolating the first and second flow ports from the third and fourth flow ports;

a second piston movably disposed within the second piston chamber and fluidly isolating the inlet and outlet flow ports from the vent port, the second piston coupled to, and configured to move in response to movement of, the first piston;

a third piston movably disposed within the third piston chamber and fluidly isolating the third piston cylinder inlet and outlet flow ports from the third piston cylinder vent port, the third piston coupled to, and configured to move in response to movement of, the first piston;

a fluidic bistable amplifier including an inlet nozzle, first and second control ports, and first and second outlet ports, the fluidic bistable amplifier inlet nozzle adapted to couple to the fluid source, the fluidic bistable amplifier first and second control ports coupled to the fourth and second flow ports, respectively, and in fluid communication with the fluidic bistable amplifier inlet nozzle upstream of where the fluidic bistable amplifier is adapted to couple to the fluid source, the fluidic bistable amplifier first and second outlet ports coupled to the first and third flow ports, respectively, the fluidic bistable amplifier configured such that (i) if fluid flows through the fluidic bistable amplifier first control port, then fluid entering the fluidic bistable amplifier inlet nozzle is directed into and through the fluidic bistable second outlet port and (ii) if fluid flows through the fluidic bistable amplifier second control port, then fluid entering the fluidic bistable amplifier inlet nozzle is directed into and through the fluidic bistable first outlet port;

a first flow orifice disposed upstream of the fluidic bistable amplifier first control port and in fluid communication with the fluidic bistable amplifier inlet nozzle upstream of where the fluidic bistable amplifier is adapted to couple to the fluid source; and a second flow orifice disposed upstream of the fluidic bistable amplifier second control port and in fluid communication with the fluidic bistable amplifier inlet nozzle upstream of where the fluidic bistable amplifier is adapted to couple to the fluid source;

a first control valve coupled to the first piston cylinder and movable between an open position and a closed position, whereby the fluidic bistable amplifier second control port is fluidly coupled to, and fluidly isolated from, the first piston chamber, respectively; and a second control valve coupled to the first piston cylinder and movable between an open position and a closed position, whereby the fluidic bistable amplifier first control port is fluidly coupled to, and fluidly isolated from, the first piston chamber, respectively.

14. A system for supplying compressed air to an aircraft hydraulic system, comprising:

a low pressure air source configured to supply a flow of relatively low pressure air;

a first piston cylinder defining a first piston chamber, the first piston cylinder including at least first, second, third, and fourth flow ports extending therethrough and in fluid communication with the first piston chamber;

a second piston cylinder defining a second piston chamber, the second piston cylinder including at least an inlet flow port, an outlet flow port, and a vent port extending therethrough and in fluid communication with the second piston cylinder, the inlet flow port coupled to the low pressure air source to receive the flow of relatively low pressure air therefrom;

a first piston movably disposed within the first piston chamber and fluidly isolating the first and second flow ports from the third and fourth flow ports;

a second piston movably disposed within the second piston chamber and fluidly isolating the inlet and outlet flow ports from the vent port, the second piston coupled to, and configured to move in response to movement of, the first piston;

a fluidic bistable amplifier including an inlet nozzle, first and second control ports, and first and second outlet ports, the fluidic bistable amplifier inlet nozzle coupled to the low pressure air source to receive the flow of relatively low pressure air therefrom, the fluidic bistable first and second control ports coupled to the fourth and second flow ports, respectively, and to the low pressure air source upstream of the fluid bistable amplifier inlet nozzle to receive the flow of relatively low pressure air therefrom, the fluidic bistable amplifier first and second outlet ports coupled to the first and third flow ports, respectively, the fluidic bistable amplifier configured such that (i) if fluid flows through the fluidic bistable amplifier first control port, then fluid entering the fluidic bistable amplifier inlet nozzle is directed into and through the fluidic bistable second outlet port and (ii) if fluid flows through the fluidic bistable amplifier second control port, then fluid entering the fluidic bistable amplifier inlet nozzle is directed into and through the fluidic bistable first outlet port;

a first control valve coupled to the first piston cylinder and movable between an open position and a closed position, whereby the fluidic bistable amplifier second control port is fluidly coupled to, and fluidly isolated from, the first piston chamber, respectively; and a second control valve coupled to the first piston cylinder and movable between an open position and a closed position, whereby the fluidic bistable amplifier first control port is fluidly coupled to, and fluidly isolated from, the first piston chamber, respectively.

15. The system of claim 14, further comprising:

an inlet check valve having an inlet port and an outlet port, the inlet check valve inlet port adapted to couple to the low pressure air source, the inlet check valve outlet port coupled to the second piston cylinder inlet flow port, the inlet check valve configured to allow the flow of relatively low pressure air into the second piston chamber and prevent air flow out of the second piston chamber; and an outlet check valve having an inlet port and an outlet port, the outlet check valve inlet port coupled to the second piston cylinder outlet flow port, the outlet check valve configured to allow air flow out of the second piston chamber and prevent air flow into the second piston chamber.

16. The system of claim 14, further comprising:

a filter disposed between the low pressure air source and the fluidic bistable amplifier inlet nozzle.

17. The system of claim 16, further comprising:

a first flow orifice disposed between the low pressure air source and the fluidic bistable amplifier first control port; and a second flow orifice disposed between the low pressure air source and the fluidic bistable amplifier second control port.

18. The system of claim 14, wherein the fluidic bistable amplifier further includes first and second leg vents fluidly coupled to the fluidic bistable amplifier first and second outlet ports, respectively.

19. The system of claim 14, wherein the first piston is moveable between at least a first position, in which the first piston is disposed adjacent the first and second flow ports, and a second position, in which the first piston is disposed adjacent the third and fourth flow ports.

20. The system of claim 19, wherein:

fluid flow through the fluidic bistable amplifier first outlet port moves the first piston toward the second position; and fluid flow through the fluidic bistable amplifier second outlet port moves the first piston toward the first position.

21. The system of claim 19, wherein:

movement of the first piston toward the first position draws fluid from the fluid source into the second piston chamber; and movement of the first piston toward the second position compresses the fluid drawn into the second piston chamber.

22. The system of claim 19, wherein:

the first piston moves the first control valve to the closed position when the first piston is moved to the first position; and the first piston moves the second control valve to the closed position when the first piston is moved to the second position.

23. The system of claim 14, wherein:

the first and second control valves are normally open, and are moved to the closed position by the first piston.

24. The system of claim 14, wherein the first and second control valves are disposed at least partially within the second and fourth flow ports, respectively.

25. The system of claim 14, wherein the first and second control valves are poppet valves.

26. The system of claim 14, further comprising:

a third piston cylinder defining a third piston chamber, the third piston cylinder including at least an inlet flow port, an outlet flow port, and a vent port extending therethrough and in fluid communication with the third piston cylinder, the third piston cylinder inlet flow port coupled to the low pressure air source to receive the flow of relatively low pressure air therefrom; and a third piston movably disposed within the third piston chamber and fluidly isolating the third piston cylinder inlet and outlet flow ports from the third piston cylinder vent port, the third piston coupled to, and configured to move in response to movement of, the first piston.

27. A fluidic compressor, comprising:

a first piston cylinder defining a first piston chamber, the first piston cylinder including at least first, second, third, and fourth flow ports extending therethrough and in fluid communication with the first piston chamber;

a second piston cylinder defining a second piston chamber, the second piston cylinder including at least an inlet flow port, an outlet flow port, and a vent port extending therethrough and in fluid communication with the second piston chamber, the inlet flow port adapted to couple to a fluid source;

a first piston movably disposed within the first piston chamber and fluidly isolating the first and second flow ports from the third and fourth flow ports;

a second piston movably disposed within the second piston chamber and fluidly isolating the inlet and outlet flow ports from the vent port, the second piston coupled to, and configured to move in response to movement of, the first piston;

a fluidic bistable amplifier including an inlet nozzle, first and second control ports, and first and second outlet ports, the fluidic bistable amplifier inlet nozzle adapted to couple to the fluid source, the fluidic bistable amplifier first and second control ports coupled to the fourth and second flow ports, respectively, and in fluid communication with the fluidic bistable amplifier inlet nozzle upstream of where the fluidic bistable amplifier is adapted to couple to the fluid source, the fluidic bistable amplifier first and second outlet ports coupled to the first and third flow ports, respectively, the fluidic bistable amplifier configured such that (i) if fluid flows through the fluidic bistable amplifier first control port, then fluid entering the fluidic bistable amplifier inlet nozzle is directed into and through the fluidic bistable second outlet port and (ii) if fluid flows through the fluidic bistable amplifier second control port, then fluid entering the fluidic bistable amplifier inlet nozzle is directed into and through the fluidic bistable first outlet port;

a first control valve coupled to the first piston cylinder and movable between an open position and a closed position, whereby the fluidic bistable amplifier second control port is fluidly coupled to, and fluidly isolated from, the first piston chamber, respectively; and a second control valve coupled to the first piston cylinder and movable between an open position and a closed position, whereby the fluidic bistable amplifier first control port is fluidly coupled to, and fluidly isolated from, the first piston chamber, respectively.

* * * * *